United States Patent [19]

Papinsick et al.

[11] 4,358,111

[45] Nov. 9, 1982

[54] PRESSURIZED, NON-REFILLABLE RECREATION BALL INFLATED WITH SULFUR HEXAFLUORIDE

[75] Inventors: John Papinsick, Summit Hill; John J. Oransky, Lansford; Shivaji Sircar, Allentown, all of Pa.

[73] Assignee: Air Products and Chemicals, Inc., Allentown, Pa.

[21] Appl. No.: 250,505

[22] Filed: Apr. 2, 1981

[51] Int. Cl.[3] ..... A63B 41/00

[52] U.S. Cl. ..... 273/61 R

[58] Field of Search ..... 273/61 R, 61 D

[56] References Cited

U.S. PATENT DOCUMENTS

| | | | |
|---|---|---|---|
| 3,047,040 | 7/1962 | Gross | 152/330 |
| 4,098,504 | 7/1978 | Koziol | 273/61 R |
| 4,166,484 | 9/1979 | Reed | 273/61 D |
| 4,340,626 | 7/1982 | Rudy | 273/61 D |

*Primary Examiner*—George J. Marlo

*Attorney, Agent, or Firm*—Geoffrey L. Chase; E. Eugene Innis; James C. Simmons

[57] ABSTRACT

A pressurized, non-refillable recreation ball inflated with a mixture of sulfur hexafluoride and air for improved shelf life and pressure retention is obtained by filling the ball with sulfur hexafluoride in a range of 65% to 75% by volume and 35% to 25% by volume of air. Preferably, the sulfur hexafluoride is present in an amount of 71% by volume. The recreation balls include tennis balls, racquet balls, squash balls, handballs and other non-refillable pressurized balls.

6 Claims, 3 Drawing Figures

TABLE I

REBOUND HEIGHT VS. TIME

| BALL NO. | REBOUND (INCHES) 1 | 2 | 3 | 4 | 5 | TIME (DAYS) |
|---|---|---|---|---|---|---|
| | 55.9 | 55.2 | 56.2 | 56.1 | 55.5 | 0 |
| | 53.8 | 55.1 | 55.9 | 56.4 | 54.6 | 22 |
| | 53.6 | 55.3 | 55.8 | 56.0 | 54.2 | 51 |
| | 51.8 | 53.0 | 54.6 | 55.4 | 52.5 | 65 |
| | 51.5 | 51.5 | 53.0 | 54.5 | 53.1 | 84 |
| | 51.5 | 51.5 | 53.2 | 53.1 | 50.0 | 98 |
| | 49.2 | 48.5 | 52.5 | 54.3 | 49.8 | 134 |
| GAS COMPOSITION | 25% $SF_6$ & AIR | 50% $SF_6$ & AIR | 75% $SF_6$ & AIR | 100% $SF_6$ | 100% AIR | |

*FIG. 1*

PRESSURIZED, NON-REFILLABLE RECREATION BALL INFLATED WITH SULFUR HEXAFLUORIDE

FIELD OF THE INVENTION

The present invention relates to pressurized, non-refillable recreation balls wherein the play characteristics or rebound potential is a function of the pressurized gas contained within the ball interior, as well as the elastic properties of the ball shell. The invention is specifically concerned with the selection of a proper concentration of a pressurizing gas of low permeability to the wall structure of the recreation ball for increased shelf life and play time.

DESCRIPTION OF THE PRIOR ART

Pressurized, non-refillable recreation balls, such as tennis, racquet, squash and handballs, have historically been of two structural types. The more predominate type is a recreation ball which is pressurized with gas, most notably air. The second type of recreation ball has been fabricated such that the interior gas zone is at ambient pressure and the play characteristics of such a ball are dependent upon the elasticity of the wall structure of the ball. This invention is directed to recreation ball structures of the former predominate type, wherein pressurized gas is a necessary component to the proper play characteristics of the recreation ball One of the major drawbacks to recreation balls which are fabricated with a pressurized gas interior is that the shelf life and the play time of such recreation balls is relatively short in duration. Such short duration of appropriate play characteristics is particularly problematic for tennis balls which must conform to official standards, particularly when used in tournament play. For instance, the typical air filled tennis ball meets the standards of the International Lawn Tennis Federation (ILTF) for only about 30 days after its initial pressurization during manufacture. This means not only short shelf life for such tennis balls, but also short play time after the ultimate sale of such an article. Other recreational balls, which must meet approved standards, present a similar problem.

The most popular prior art attempt to avoid such short durations of recreation ball acceptability has been to package air pressurized recreation balls in air pressurized containers. Such a packaging scheme will maintain air pressurized recreation balls over an indefinite period of time, so long as the container remains pressurized. However, the drawbacks to this solution to maintaining air pressurized recreation balls over a sustained period of time is that the pressurized containers are expensive and upon opening of the container to utilize the recreation balls, the effects of the container are lost and the balls are susceptible to their natural depressurization and play characteristic degradation.

Another approach to the problem of preserving the play characteristics of such balls is set forth in U.S. Pat. No. 4,098,504 to Koziol et al. In that patent, the use of sulfur hexafluoride in admixture with air as the inflation medium for tennis balls is disclosed. The proportion of sulfur hexafluoride utilized appears to be in the 50 to 60 percent by volume range. Based upon the minimum pressure requirements specified in this patent of 13 psig, this sulfur hexafluoride content range would provide a shelf life of 200 to 300 days. The specification gives examples of partial pressures of sulfur hexafluoride in the amount of 50%, 60% and 100%, the latter of which was deemed to be unacceptable due to excessive pressure increases.

An additional patent of interest is U.S. Pat. No. 3,047,040 which teaches the use of sulfur hexafluoride for the inflation of motor vehicle tires. Longevity of inflation is not a stated objective of this patent.

SUMMARY OF THE INVENTION

It is an object of the present invention to provide a pressurized, non-refillable recreation ball which is inflated with a mixture of sulfur hexafluoride and air in such proportions so as to maximize shelf life and play characteristic retention over a period of time beyond that of the prior art. Within this specification and according to the present invention, such a pressurized, non-refillable recreation ball is deemed to be any ball which is used at internal cold pressures above atmospheric pressure, wherein the ball is not ordinarily refillable such as by a valve or orifice (although not necessarily impenetrable by a puncturing needle) and the ball is used for recreational or sport events where a range of playability, bounce, weight or rebound characteristics is important to a satisfactory or acceptable ball performance. Such balls include, but are not limited to tennis balls, squash balls, racquet balls and handballs.

Particularly, it is an object of the present invention to provide a pressurized recreation ball wherein the sulfur hexafluoride content is in the range of 65% to 75% by volume and where the remaining 35% to 25% of volume is comprised of air.

More particularly, it is an object of the present invention to provide a pressurized recreation ball wherein the sulfur hexafluoride content is 71% by volume and the air content is 29% by volume.

A further object of the present invention is to provide a tennis ball which is pressurized with sulfur hexafluoride in the range of 65 to 75% by volume and, specifically, 71% sulfur hexafluoride by volume.

Shelf lives in excess of 375 days and even 453 days are achieved by constructing a pressurized, non-refillable recreation ball with an elastomeric shell wherein the ball is pressurized with a mixture of sulfur hexafluoride and air comprising from 65 to 75% by volume of sulfur hexafluoride.

BRIEF DESCRIPTION OF THE DRAWINGS

FIG. 1 is a table of rebound height versus time for various concentrations of sulfur hexafluoride in tennis balls.

DESCRIPTION OF THE PREFERRED EMBODIMENT

Figure 2:
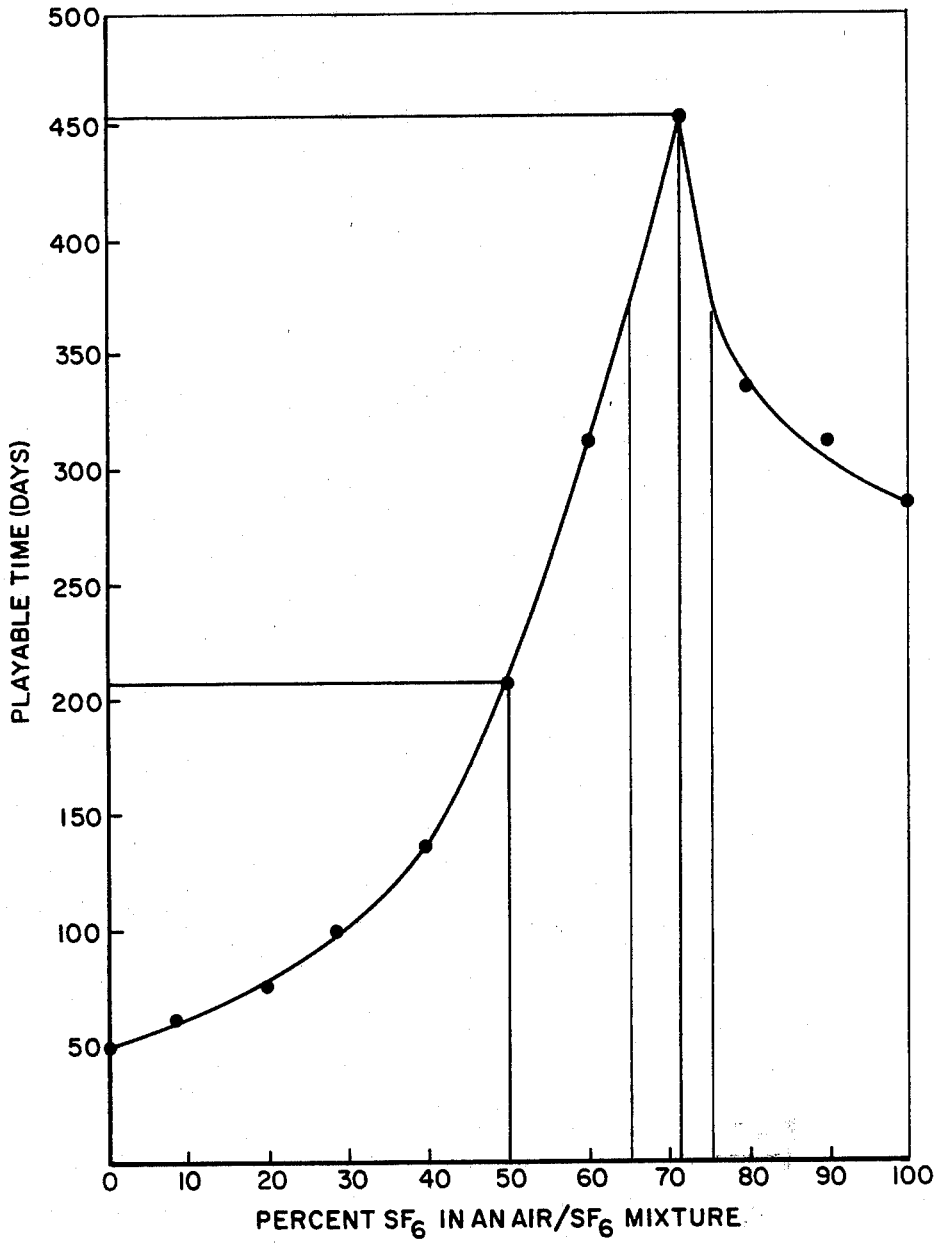
FIG. 2 is a graph of sulfur hexafluoride concentrations versus length of playable time before reaching 11.7 psig of internal pressure in tennis balls.

The present invention is directed to a pressurized, non-refillable recreation ball, such as a tennis ball, squash ball, racquet ball or handball, but the preferred embodiment will be described with reference to a tennis ball. Although experiments were conducted with respect to tennis balls, the below described mathematical model and the applicability of the findings to other such recreation balls is apparent, and such balls are within the scope of the following discussion.

The present invention is further directed to a pressurized, non-refillable recreation ball wherein an elastomeric or natural rubber outer shell is inflated with a gas mixture of sulfur hexafluoride and air. The sulfur hexafluoride has a low rate of permeation outward through such elastomeric or natural rubber shell because of its low solubility in relation to wall structure and its large, spread molecular orientation. This orientation is the result of the octahedral shape of the sulfur hexafluoride molecule, wherein the sulfur atom is surrounded by the six fluorine atoms. The recreation ball of the present invention is designed so as to maximize the benefit of the use of sulfur hexafluoride in pressurization of the ball.

In order to provide an optimum tennis ball, the play characteristics of the ball must remain in a certain range as set forth by the International Lawn Tennis Federation (ILTF) and other governing tennis organizations. It is not sufficient merely to exceed certain minimum levels of pressurization, because the standards set both maximum and minimum requirements. The ILTF requirements for tennis balls are set at a temperature of 20° C., a relative humidity of 60% and require:

A. A diameter of 2.575 to 2.700 inches.

B. A weight of 2 to 1-1/16 ounces.

C. A rebound potential from a height of 100 inches onto a concrete surface of from 53 to 58 inches.

D. (i) A deformation under 18 LBF load of 0.230 to 0.290 inches.

(ii) A deformation under 18 LBF load on recovery after the ball has been compressed through 1 inch, of 0.355 to 0.425 inches.

Because it is known that the pressure retention of a tennis ball is positively related to the concentration of sulfur hexafluoride, yet the standards for tennis ball acceptability by the ILTF provides for maximums in the acceptability range, it is not apparently obvious what the optimum sulfur hexafluoride concentration in a tennis ball should be. As pointed out by the prior art, the use of 100% sulfur hexafluoride creates too great a pressure in a tennis ball due to the equilibration of air into the tennis ball more rapidly then the sulfur hexafluoride permeates out of the tennis ball.

In the present invention, in order to determine the optimum concentration of sulfur hexafluoride in a recreation ball, such as a tennis ball, tests were run on various batches of tennis balls respectively filled with differing mixtures of sulfur hexafluoride and air as well as the development of a mathematical model that conforms to the data on experimental sulfur hexafluoride tennis balls.

As shown in the table of FIG. 1, a series of experiments on various tennis ball batches were run with respect to rebound height versus time. In each batch of the experimental tennis balls utilized in the table discussed above, the inflation pressure was maintained initially at 29.4 psia during introduction of gas or gas and air mixtures into the tennis balls. However initial pressures of between 27.9 and 30 psia are generally deemed satisfactory. In conducting the above tests, the tennis balls were stored at 20° C. and were tested daily by either dropping the balls from a 100 inch height onto concrete and measuring the rebound, or calculating the internal pressure of the various tennis balls on a daily basis. Tennis balls having concentrations of: 25% sulfur hexafluoride and 75% air; 50% sulfur hexafluoride and 50% air; 75% sulfur hexafluoride and 25% air; 100% sulfur hexafluoride, and 100% air were run in these tests. All data entries are the average of ten balls tested at each concentration. The range of acceptable rebound as specified by the ILTF consists of the range of 53 to 58 inches or rebound. As shown by the data, one would be led to believe that 100% sulfur hexafluoride would offer the optimal conditions. The data appear to show a relationship between increasing sulfur hexafluoride concentrations and optimum conditions for tennis balls. In fact, a significant margin of greater rebound performance is shown for higher concentrations of sulfur hexafluoride. However, as stated previously, the use of 100% sulfur hexafluoride creates a problem with the increased pressurization of tennis balls due to the equilibration of air across the membrane of the tennis ball shell. Overpressurization and performance above the maximum desired are experienced by such pure sulfur hexafluoride balls.

Therefore, one must resort to additional data to obtain the optimum concentration for an acceptable and playable recreation ball, such as a tennis ball. Such data for the pressurization of tennis balls closely obey the following formula derived by the inventors for the partial pressures of gases contained in recreation balls, generally:

$$p(t)=1+p_1^0e^{-\alpha_1 t}+(p_2^0-0.79)e^{-\alpha_2 t}+(p_3^0-0.21)e^{-\alpha_3 t}$$

wherein pressure is a function of time and the various partial pressures are as follows:

$p_1$ = sulfur hexafluoride $p_2$ = nitrogen $p_3$ = oxygen

The particular outer shell composition of a tennis ball has an effect on the mathematical model and is adjusted for in the alpha exponent wherein:

$$\alpha=(3RT/rl)\cdot\overline{P_1}$$

The latter figure, $\overline{P_1}$, is the permeability of the particular tennis ball casing utilized. It can differ depending on the particular shell makeup, which is usually compounded natural rubber. R is a gas constant; T is temperature, r is the radius of the ball, and L is the thickness of the rubber shell.

This mathematical model, which closely approximates the experimental data, was used to predict the variations of pressure versus time in tennis balls when the sulfur hexafluoride and air concentrations were varied. The mathematical model was derived from Fick's Law of diffusion and other related equations used in demonstrating mass transfer phenomena as set forth in the text *Physical Chemistry* by Gilbert W. Castellan (Mass., Addison-Wesley Pub. Co. 1971) at pages 688–705, the text of which is incorporated herein by reference.

Utilizing the 11.7 psig of internal pressure as the minimum necessary for an acceptable tennis ball as derived by experimental bounce testing, FIG. 2 shows the graph for a series of tennis balls for a number of sulfur hexafluoride concentrations as a function of playable time. It can be seen that a preferred mixture falls at a point wherein the sulfur hexafluoride concentration is 71% of the inflation medium. A preferred range of 65% to 75% sulfur hexafluoride falls at the point of greatest positive and negative slope in FIG. 2. However, this is only one criterion for the ascertainment of the optimum sulfur hexafluoride level for a tennis ball.

Figure 3:
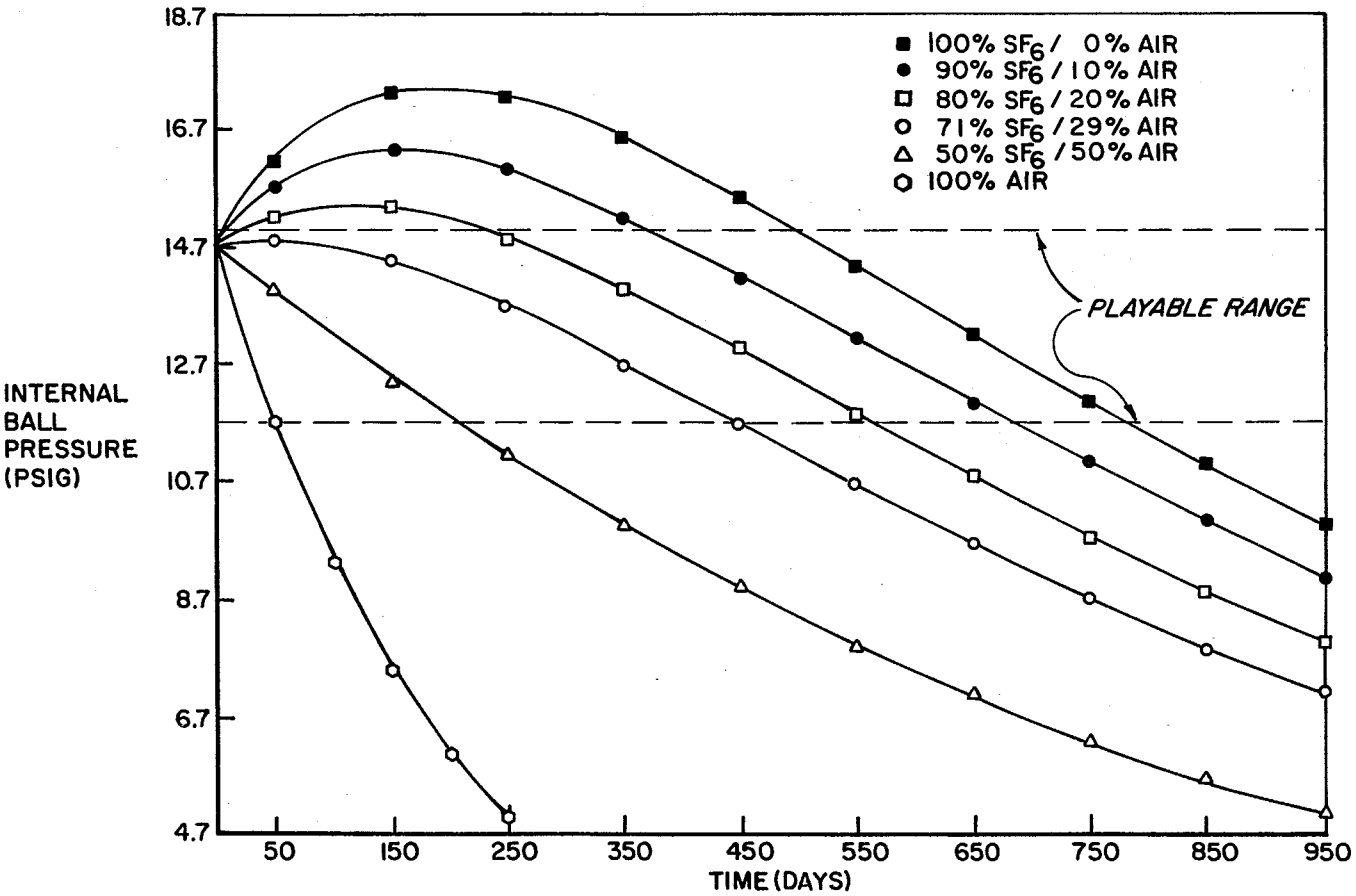
FIG. 3 is a graph of internal ball pressure versus time for various concentrations of sulfur hexafluoride in tennis balls.

As shown in FIG. 3, wherein internal ball pressure is plotted against time and the range for a playable tennis ball is denoted as comprising the area between 11.7 and 15 psig, it is shown that an optimum gas concentration consists of 71% sulfur hexafluoride and 29% air. Sulfur hexafluoride concentrations above that optimum concentration tend to pressurize initially above the playable range due to the equilibration of air into the tennis ball core. Sulfur hexafluoride concentrations below this optimal value fail to retain playable pressure ranges for the maximum period of time.

Tennis balls which pressurized above the acceptable playable range after initial pressurization were considered to have terminated their acceptable shelf life upon going above such playable range. Similarly, tennis balls which fell below an acceptable playable range after initial pressurization were also deemed to have terminated their shelf life at that time. Upward pressure variations after initial pressurization were not deemed to terminate the shelf life of the experimental tennis balls as long as this pressurization remained within the playable range.

As can be seen from the above described figures, the shelf life of a tennis ball which incorporates a 71% concentration of sulfur hexafluoride can be extended to at least 450 days. In this context, shelf life is that period during which tennis balls meet the requirements currently set down by the International Lawn Tennis Federation and the experimentally derived pressure ranges which equate to those requirements.

Although the optimum sulfur hexafluoride content for tennis balls and more generally, recreation balls appears to be 71% with the remaining 29% air, the characteristics of the particular recreation ball shell play a part in the determination of the specific sulfur hexafluoride content for various recreation ball structures. This is deemed to be related to the gas permeability of the various elastomeric components of recreation ball shell, as well as the characteristics of resiliency that such elastomeric materials have separately from the pressurization or gas content in the respective recreation ball structures. Therefore, it is possible to have slight variations in the optimum ratios of sulfur hexafluoride for a given recreation ball structure within the preferred range of the present invention, namely; 65% to 75% sulfur hexafluoride. In addition, it is entirely possible that other gas mixtures having similar permeability to that of air could be utilized as the second component of the two component system comprising a majority of sulfur hexafluoride as set forth in this invention.

Further, the particular structure of the recreation ball, whether it is a tennis ball, squash ball, racquet ball or handball, may alter the exact optimum ratio of sulfur hexafluoride slightly within the range of 65% to 75% by volume. However, the mathematical model derived for this invention takes into account these variations in diameter and shell composition so that these ball variations are deemed to be within the scope of this invention.

What is claimed is:

1. A pressurized, non-refillable recreation ball inflated with a mixture of sulfur hexafluoride and air to maximize shelf life and play characteristic retention wherein the sulfur hexafluoride is present in a range of 65% to 75% by volume of the total gas content of said ball.

2. The invention of claim 1 wherein the gas content of the ball comprises 71% by volume of sulfur hexafluoride and 29% by volume of air.

3. The invention of claim 1 or 2 wherein the ball is a tennis ball.

4. The invention of claim 1 or 2 wherein the ball is a racquet ball.

5. The invention of claim 1 or 2 wherein the ball is a squash ball.

6. The invention of claim 1 or 2 wherein the ball is a handball.

* * * * *